US007056241B1

(12) United States Patent
Ishino

(10) Patent No.: US 7,056,241 B1
(45) Date of Patent: Jun. 6, 2006

(54) VOLLEYBALL NET SUPPORT SYSTEM

(76) Inventor: Edmund S. Ishino, 6676 W. Leawood Dr., Littleton, CO (US) 80123

( * ) Notice: Subject to any disclaimer, the term of this patent is extended or adjusted under 35 U.S.C. 154(b) by 0 days.

(21) Appl. No.: 10/853,535

(22) Filed: May 25, 2004

(51) Int. Cl.
*A63B 69/00* (2006.01)

(52) U.S. Cl. ..... 473/459; 473/473

(58) Field of Classification Search ..... 473/490, 473/491, 493, 459, 473, 431, 432
See application file for complete search history.

(56) References Cited

U.S. PATENT DOCUMENTS

| | | | | |
|---|---|---|---|---|
| 855,219 | A | | 5/1907 | Anthony Jr. |
| 1,371,867 | A | | 3/1921 | Dean |
| 1,537,738 | A | | 5/1925 | Bisbing |
| 2,003,162 | A | | 5/1935 | Ulmer |
| 2,615,715 | A | | 10/1952 | Moore |
| 2,842,268 | A | | 7/1958 | Gumplo |
| 2,895,737 | A | | 7/1959 | Blees |
| 2,944,816 | A | | 7/1960 | Dixon |
| 3,328,033 | A | | 6/1967 | Hendry |
| 3,758,116 | A | | 9/1973 | Pieronek |
| 3,802,703 | A | | 4/1974 | Van Tassel |
| 3,918,711 | A | | 11/1975 | Zak |
| 3,955,511 | A | | 5/1976 | Bak |
| 3,986,719 | A | | 10/1976 | Lee |
| 4,291,885 | A | | 9/1981 | Cohen |
| D271,507 | S | | 11/1983 | Phillips et al. |
| 4,717,157 | A | | 1/1988 | Smith |
| 4,718,668 | A | | 1/1988 | Schipske |
| 4,895,366 | A | | 1/1990 | Bartasius |
| D317,033 | S | | 5/1991 | Rains |
| 5,037,095 | A | | 8/1991 | Nedwick |
| 5,042,820 | A | | 8/1991 | Ford |
| 5,062,646 | A | * | 11/1991 | Crist ..... 473/432 |
| 5,080,375 | A | | 1/1992 | Moosavi |
| D333,856 | S | | 3/1993 | Cantey |
| 5,193,802 | A | | 3/1993 | Saltus |
| D359,538 | S | | 6/1995 | Hague |
| 5,439,152 | A | | 8/1995 | Campbell |
| 5,470,056 | A | | 11/1995 | Dennesen |
| 5,472,212 | A | * | 12/1995 | Bercaw ..... 473/462 |
| D371,587 | S | | 7/1996 | Braun |
| 5,556,064 | A | | 9/1996 | Cowe |
| 5,558,338 | A | | 9/1996 | Taub |
| 5,599,031 | A | | 2/1997 | Hodges |
| 5,660,637 | A | | 8/1997 | Dodge |
| 5,692,978 | A | * | 12/1997 | Hummel ..... 473/459 |
| 5,816,956 | A | | 10/1998 | Ellis et al. |
| 5,827,137 | A | * | 10/1998 | Ishino ..... 473/459 |
| D405,578 | S | | 2/1999 | Shumake |
| 5,947,831 | A | | 9/1999 | McCarthy |

(Continued)

*Primary Examiner*—Raleigh W. Chiu
(74) *Attorney, Agent, or Firm*—Ramon L. Pizarro; Edwin H. Crabtree

(57) ABSTRACT

A volleyball practice system that includes a support frame with a pair of post supports. Each of the post supports being mounted on a base that is supported on wheels, and the pair of post supports being connected to one another by a telescoping or adjustable horizontal member. A backdrop net with a pair of opposite ends along a lower edge that are adapted for tethering to an anchoring point supported by the post supports, so that the opposite ends of the lower edge of the backdrop net may be raised or lowered relative to the upper edge of the backdrop net, so that the backdrop may be used to retain or release balls by adjusting the height of the opposite ends of the backdrop net.

15 Claims, 5 Drawing Sheets

U.S. PATENT DOCUMENTS 6,402,641 B1 6/2002 Lee
6,659,893 B1 * 12/2003 Campbell et al. ..... 473/459
6,802,789 B1 * 10/2004 Ishino ..... 473/459
2005/0079934 A1 * 4/2005 Forman ..... 473/459

* cited by examiner

VOLLEYBALL NET SUPPORT SYSTEM

REFERENCE TO RELATED APPLICATIONS

Some of the material in this application is also found in my application having Ser. No. 10/099,445, now U.S. Pat. No. 6,802,789, incorporated herein in its entirety by reference, which was filed on Mar. 14, 2002 and claims the benefit of my provisional application having Ser. No. 60/276,290, filed Mar. 15, 2001, now abandoned.

BACKGROUND OF THE INVENTION (a) Field of the Invention

This invention generally relates to a portable volleyball or ball catching and return system. More particularly, but not by way of limitation, to a portable and collapsible frame and volleyball catching and backdrop system that can be configured in various forms, such as to catch and return, hold, and drop a ball tossed against the backdrop of system by a user.

(b) Discussion of Known Art

Volleyball, like any other sport, requires a great deal of practice. Unfortunately, however, volleyball is a team sport, which makes practice of particular aspects of the game by individual players difficult. Furthermore, the equipment used for volleyball takes up a large area, making the practice of the game by an individual difficult in that the space for playing volleyball may be put to use by other individuals for other sports. For example, the floor of a gymnasium may be used for practice by a basketball team, preventing the concurrent use of the floor.

Accordingly, there is a need for a device that allows an individual to train in the various aspects of volleyball without taking up the same amount of room as may be needed for a standard volleyball game. Still further, there remains a need for a volleyball practice system that allows individual players or small groups of players, to practice specific plays or aspects of volleyball. For example, there remains a need for a system that allows players to practice serves, spikes, setting or other aspects of volleyball without having to use an entire volleyball court.

Still further, there remains a need for a device or system that allows the use of the catching net as a collection mechanism as well as a return mechanism, where the catching net accepts and allows the ball to roll back to the person hitting the ball. Also, there remains a need for a mechanism that allows a user to support and transport all of the components needed for practicing various aspects of volleyball, and then collapse the system such that it can be put away in a relatively small area together with all of the components needed to practice the various aspects of volleyball.

SUMMARY

It has been discovered that the problems left unanswered by known systems are solved by providing a practice system that includes:

A support frame, the support frame including a pair of post supports, each of the post supports being mounted on a base that is supported on wheels, the pair of post supports being connected to one another by a telescoping or adjustable horizontal member;

A backdrop net, the backdrop net having an upper edge and a lower edge that is at a distance from the upper edge of the backdrop net, the lower edge of the backdrop net having a pair of opposite ends, each of the opposite ends being adapted for tethering each of the opposite ends to an anchoring point supported by the post supports, so that the opposite ends of the lower edge of the backdrop net may be raised or lowered relative to the upper edge of the backdrop net, so that the backdrop may be used to retain or release balls by adjusting the height of the opposite ends of the backdrop net.

According to one example of the disclosed invention the support frame also supports a volleyball net section, the volleyball net section including an upper edge and a lower edge, the upper edge of the volleyball net section being supported below the upper edge of the backdrop net. Thus it is contemplated that the opposite ends of the lower edge of the backdrop net may be raised to create a trough below the upper edge of the backdrop net in order to catch and collect balls that strike the backdrop net or the volleyball net section. Once the user is finished with driving balls against the backdrop net or the system, then the user may simply release one or both of the opposite ends of the lower edge of the backdrop net in order to release the balls that have been collected.

Additionally, it is contemplated that the height of the opposite ends of the lower edge of the backdrop net may be adjusted by lowering them to a position where both ends are curled up, creating a funnel path at approximately mid-span between the opposite ends that causes the balls that strike the backdrop net to roll back towards the user.

The accompanying figures show how to use disclosed components of the invention, including the use of a backdrop net, or first flexible panel, capable of extending above and below a standard net or truncated section of volleyball net, or second flexible panel to produce the following configurations:

Catch and Hold Configuration—

This configuration is achieved by connecting the lower opposing corners, also referred to herein as opposite ends of the lower edge of the backdrop panel, to the vertical supports. This will form a fold or pouch or trough in the first flexible panel. The first flexible panel shall be behind the lower net with respect to the hitter. The hitter hits the ball into the first flexible panel and the ball will be directed down between the two nets and fall into the pouch and remain there.

Catch and Return Configuration—

This configuration is achieved by supporting the lower opposing corners of the backdrop net, also referred to as the first flexible panel, with a specific slackness. The upper net shall be behind the lower net with respect to the hitter. The hitter hits the ball into the upper net and the ball will be directed down between the two nets. The upper net redirects the downward momentum of the ball and returns the ball to the hitter.

Catch and Drop Configuration—

This configuration is similar to the Catch & Return configuration, except that one or both of the lower opposing corners are disconnected and the ball will fall freely-below and behind the nets.

Target Rebound Configuration—

This configuration is achieved by supporting the backdrop panel, also referred to as the first flexible panel, in a taught manner to provide an elastic backdrop for the balls that strike the backdrop panel. The hitter hits the ball against the backdrop panel and the ball rebounds directly back.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
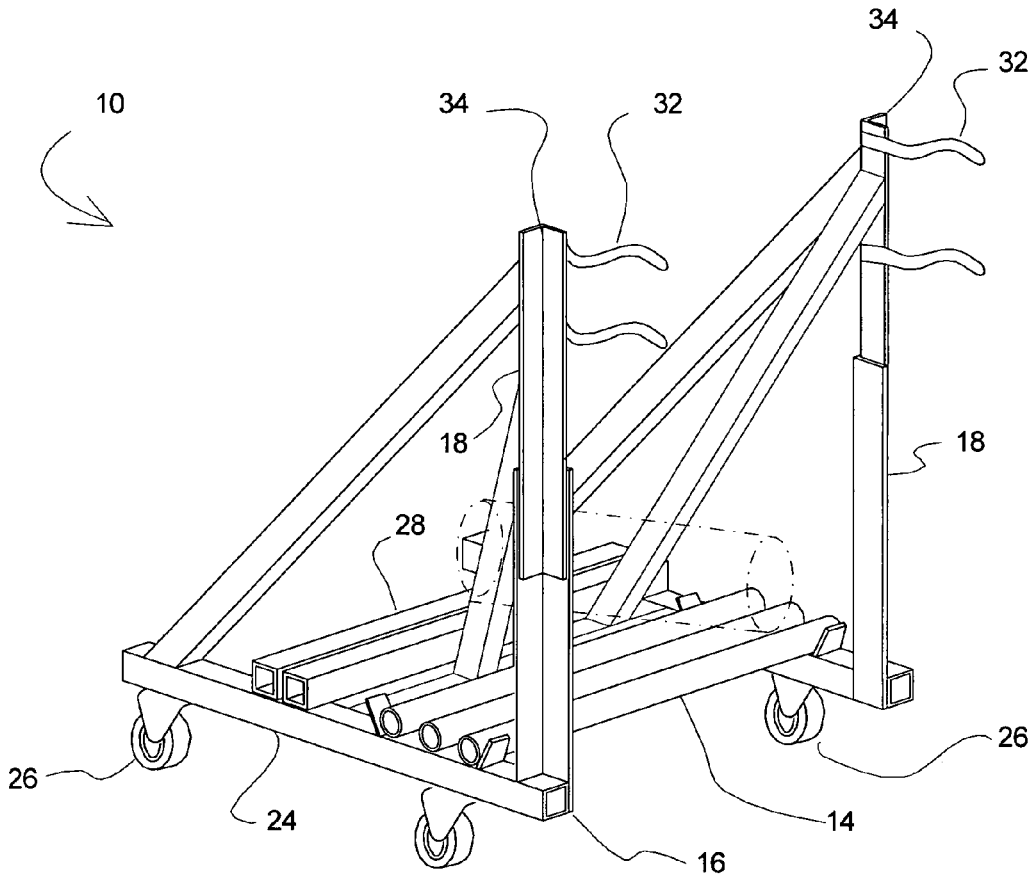
FIG. 1 is a perspective view of an embodiment of the frame used with the disclosed invention.

Turning to FIG. 1 it will be understood that the problems that were left unsolved by the prior art have been solved by providing a portable volleyball practice system 10 that is used for supporting a volleyball net or volleyball net section 12, which is in turn mounted on a pair of posts 14. The disclosed system is designed to be portable, easily collapsed and stored together with all items needed for practice, and versatile in that it can be rearranged to perform a wide variety of tasks or practice modes.

The example of the disclosed invention, which has been illustrated in FIG. 1 includes a support frame 16 that is collapsible. The frame 16 can collapse between a first configuration, which is suitable for storage and has been illustrated in FIG. 1, and then to a second configuration, which is suitable for practice. The second configuration has been illustrated in FIG. 2.

Figure 2:
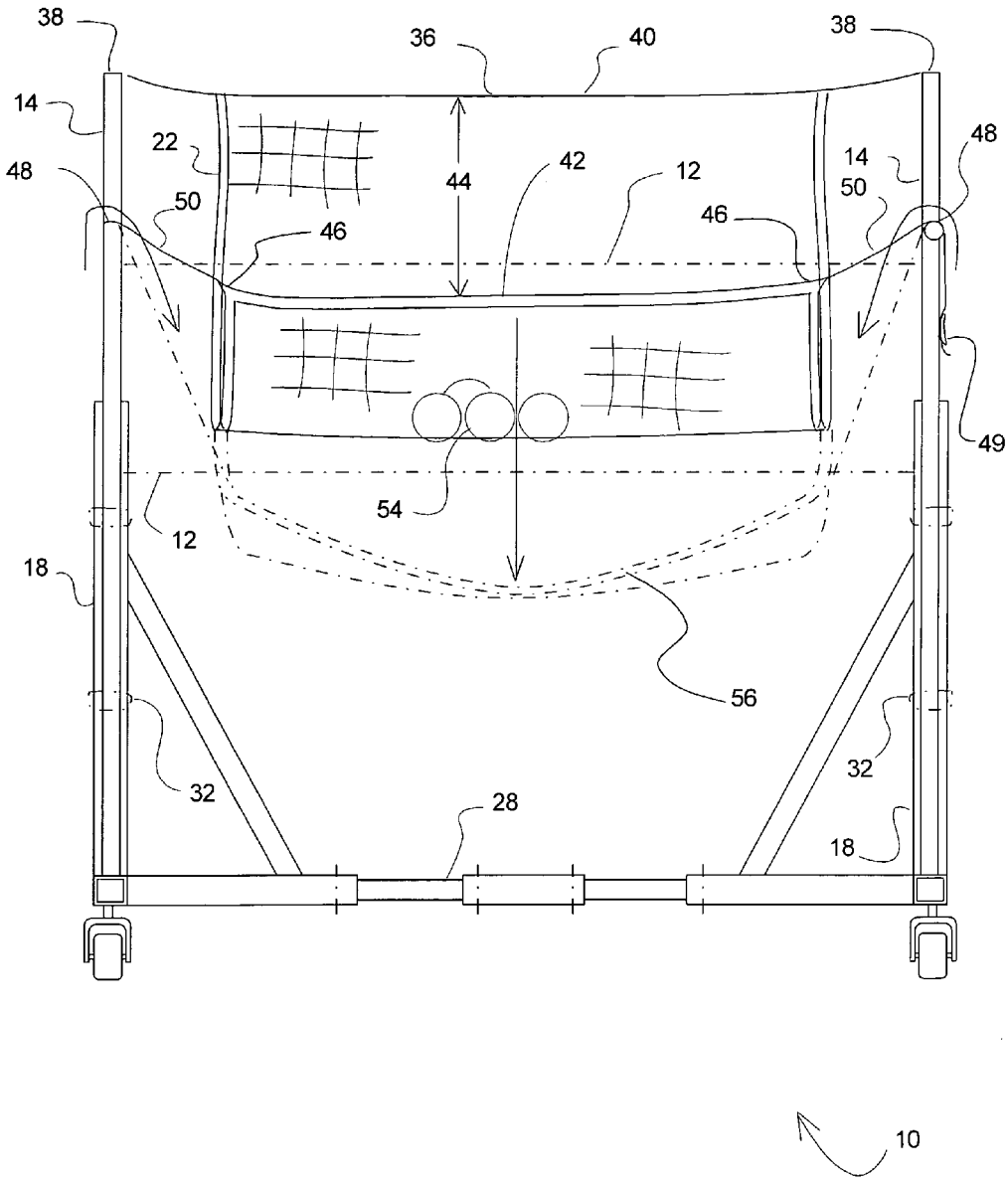
FIG. 2 illustrates the use of the backdrop panel in a position that allows the backdrop panel to catch and collect balls, and also illustrates (in broken lines) how the lower edge of the backdrop net may be adjusted by lowering them to a position where both ends are curled up, creating a funnel path at approximately mid-span between the opposite ends.

As illustrated in FIGS. 1 and 2, the support frame 16 includes a pair of elongated post supports 18 that have been adapted for supporting the posts 14 that will in turn support a backdrop net 22 as well as the volleyball net section 12. Each of the elongated post supports 18 is mounted on a base 24 that is, in turn, preferably supported on wheels 26.

Figure 3:
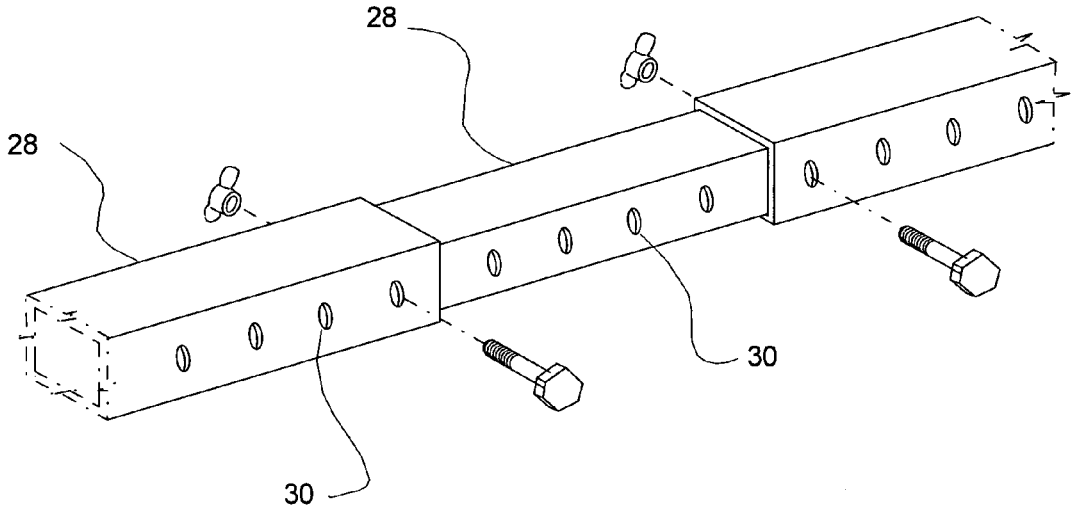
FIG. 3 illustrates the telescoping center-beam or adjustable horizontal member that is used to adjust the width of the support frame.

FIG. 3 illustrates that in order to allow the frame 16 to collapse, a horizontal member 28 of adjustable length connects each of the bases 24 to one another. The illustrated example of the horizontal member 28 allows expansion by way of a telescoping arrangement that also includes several connection points 30 or adjustment graduations. It is important to note that the telescoping function is merely one manner in which the collapsing function may be achieved. It is contemplated that scissor-type expansion mechanism, or screw-driven mechanism, as well as other mechanisms may also be used. However, the preferred example has been illustrated using telescoping sections of tubing, which will accommodate a broad range of expansion.

Once the bases 24 have been spaced apart at a suitable distance from one another, and this distance has been fixed through the use of the connection points 30, then the posts 14 may be mounted against the post supports 18. It is contemplated that the posts 14 will be fastened or retained against the post supports 18 by straps 32, or clamps, fasteners, or other devices that serve as adjustable retainers that extend across the recess 34 fasten the posts 14 against the supports 18. Additionally, it is important to note that each of the post supports will include a recess 34, which will preferably be an elongated recess that has been adapted for accepting one of the posts 14 in a generally parallel fashion relative to the post support 18. In the illustrated example this recess 34 or elongated recess is defined by an angle section of metal. Thus, it is contemplated that the recess 34 may be formed from angle iron, channel sections, or by other sections of rigid material.

Referring once again to FIG. 2 it will be understood that once the frame 16 has been adjusted to the desired width, and the posts 14 mounted from the post supports 18, then a backdrop net 36 will be mounted from the upper ends 38 of the posts 14. The backdrop net 36 will include an upper edge 40 and a lower edge 42 that are separated by a distance 44 from one another. Additionally, the lower edge 42 of the backdrop net 36 includes a pair of opposite ends 46. Each of the opposite ends 46 has been adapted for attaching a rope or other flexible connector that allows tethering of each of the opposite ends 46 to an anchoring point 48 that is supported by the post supports 18, and preferably by the posts 14. It is contemplated that the anchor point 48 may include a releasable retainer 49, such as a cleat or other device that secures the position of the rope.

The opposite ends 46 of the lower edge 42 of the backdrop net 36 will be tethered to the anchoring point 48 so that the length of the rope connected to the opposite ends 46 may be adjusted by lengthening or shortening the length between the opposite ends 46 and the anchoring point 48. Thus by placing the anchoring point 48 at a distance below the upper edge 40 that is less than the length of the backdrop panel, one or both ends 46 may be raised shortening the length of rope between the opposite ends and the anchoring point 48, or lowered by lengthening the amount of rope between the ends 46 and the anchoring point 48.

Figure 4A:
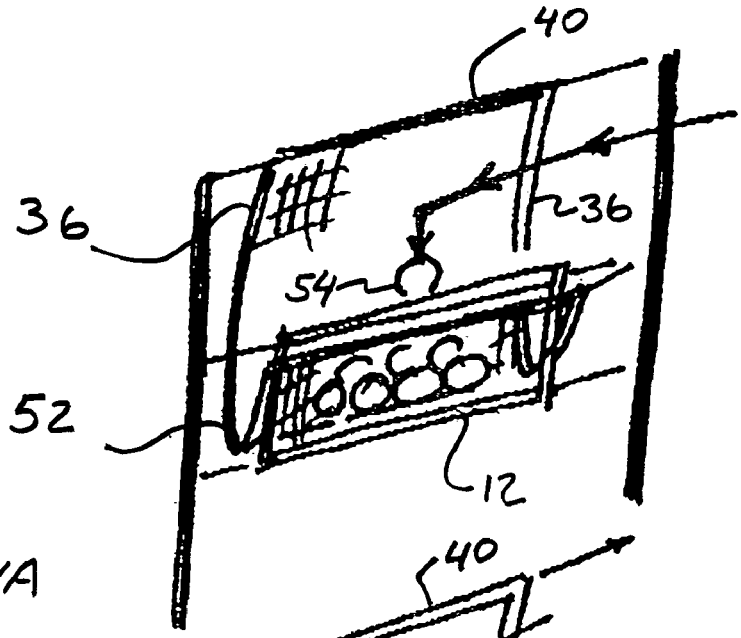
FIG. 4A illustrates the disclosed invention in a catch and hold arrangement.
Figure 4B:
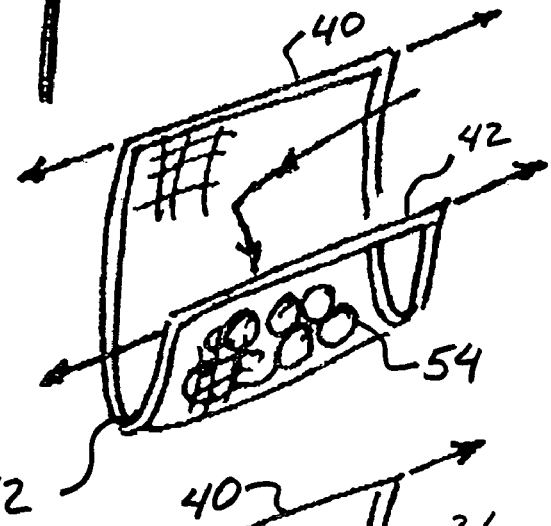
FIG. 4B illustrates backdrop panel by itself while in the catch and hold arrangement.
Figure 4C:
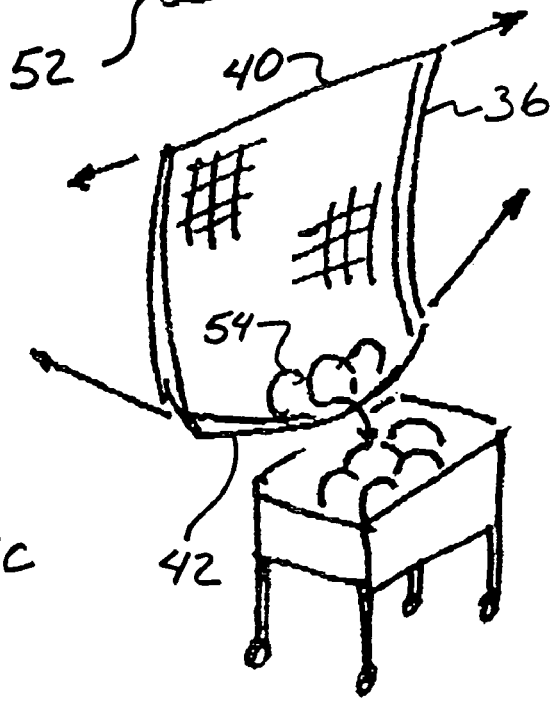
FIG. 4C illustrates the release one or both ends of the lower edge of the backdrop panel to create an acute catenary shape along the lower edge, having both ends curled up, creating a funnel path at approximately mid-span between the opposite ends.
Figure 5A:
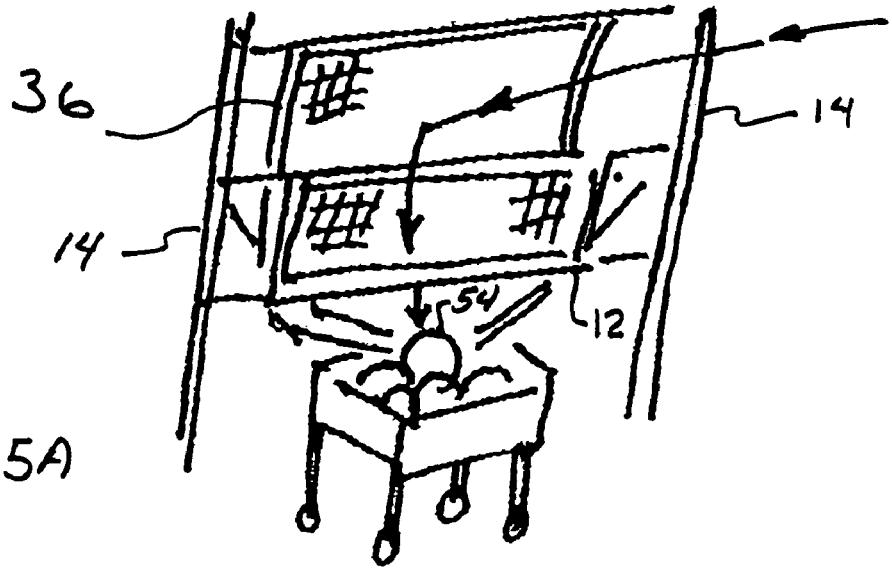
FIG. 5A illustrates the disclosed invention in a catch and deposit configuration, allowing the balls to be dropped into a collection cart.
Figure 5B:
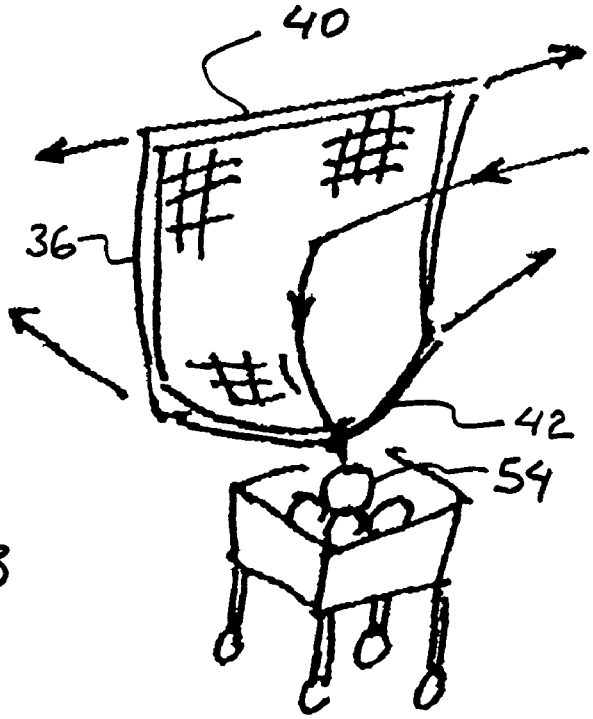
FIG. 5B illustrates the function of the backdrop panel in the catch and deposit mode.

As illustrated in FIGS. 3, 4A–4C, and 5A–5B, raising or lowering one or both ends 46 relative to the upper edge 40 of the backdrop net 36 will allow the system to be used to perform various different functions. For example, by raising one or both ends, and pulling the lines 50 taught, one can create a trough 52 that catches and holds balls 54 that have struck the backdrop net 36. Accordingly, as illustrated in FIGS. 2 and 4A–4B, the use of the backdrop net 36 in conjunction with the volleyball net section 12 to practice serving over the volleyball net section 12 while the balls 54 are collected in the trough 52. The trough 52 may be formed by pulling the lower edge 42 up between the volleyball net section 12 and the backdrop net 36 or by pulling the lower edge up under at least part of the front of the volleyball net section 12, so the backdrop net 36 may be used to catch and collect balls that clear the volleyball net section 12.

In order to release the balls from the trough 52, the user simply releases at least one of the lines 50 to allow the lower edge 42 to drop, forming a catenary arch 56 along the lines 50 and the lower edge 42 of the backdrop net 36. This catenary arch 56 will funnel or direct the balls to fall through the lowest point on the arch 56. Accordingly, it would be advantageous to place a cart 58 below the lowest point of the arch 56 in order to retrieve the balls collected in the trough 52. Alternatively, it is contemplated that one may use the catenary arch 56 in order to avoid collecting the balls 54, and allowing the balls to be funneled by the backdrop net 36, through the catenary arch 56 and back to the player.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A volleyball practice system for catching and selectively releasing at least one volleyball, the system comprising:

a pair of vertical support posts;

a horizontal member of adjustable length, the horizontal member being attached to at least one of the vertical support posts at a fixed orientation relative to the vertical support post to which it is attached;

a backdrop net, the backdrop net having an upper edge and a lower edge that is at a backdrop net distance from the upper edge of the backdrop net, the upper edge being supported from the pair of vertical supports, the lower edge of the backdrop net having a pair of opposite ends, each of the opposite ends being tethered to an anchoring point supported by the post supports or a volleyball net lower attachment rope, the anchoring point being below the upper edge of the backdrop net at a distance from the upper edge of the backdrop net that is smaller than the backdrop net distance, so that when the opposite ends of the lower edge of the backdrop net are supported from the vertical support posts they can be moved from a first position where the lower edge of the backdrop net is generally parallel to the upper edge of the backdrop net to a second position where the lower edge of the backdrop net assumes a catenary profile, so that the backdrop net may be used to retain or release balls by adjusting the height of the opposite ends of the backdrop net.

2. A volleyball practice system according to claim 1, wherein said anchoring point comprises cleat.

3. A volleyball practice system according to claim 2 wherein said support posts are mounted on a movable frame having wheels.

4. A volleyball practice system according to claim 1 and further comprising a volleyball net section that is support in a generally parallel fashion and spaced apart from the backdrop net.

5. A volleyball practice system according to claim 4 and wherein said lower edge of said backdrop net is permanently retained in said second position.

6. A portable volleyball practice system for supporting a volleyball net mounted on a pair of posts, the system comprising:

a support frame, the support frame including a pair of elongated post supports, each of the elongated post supports being mounted on a base that is supported on wheels, each of the bases being connected to one another by a horizontal member of adjustable length, each of the post supports including:

an elongated recess adapted for accepting one of the posts in a generally parallel fashion relative to the post supports; and at least one adjustable retainer that has been adapted for fastening the posts against the recess; and a backdrop net, the backdrop net having an upper edge and a lower edge that is at a distance from the upper edge of the backdrop net, the lower edge of the backdrop net having a pair of opposite ends, each of the opposite ends being adapted for tethering each of the opposite ends to an anchoring point supported by the post supports, so that the opposite ends of the lower edge of the backdrop net may be raised or lowered relative to the upper edge of the backdrop net, so that the backdrop may be used to retain or release balls by adjusting the height of the opposite ends of the backdrop net.

7. A volleyball practice system according to claim 6, wherein each of said post supports comprises an angled section, the angled section incorporating the recess adapted for accepting one of the posts in a generally parallel fashion relative to the post supports.

8. A volleyball practice system according to claim 6 wherein said at least one retainer comprises at least one strap that has been adapted for extending around the posts when the posts are mounted within the post supports, so that the posts are fastened against the post supports with the use straps.

9. A volleyball practice system according to claim 6 wherein each of said bases includes a support rack that are generally aligned with one another when said frame is in a collapsed position, so that the support racks on each base provide a support surface for posts.

10. A volleyball practice system according to claim 6 and further comprising a releasable retainer for engaging a rope connected to one of the opposite ends of the lower edge of the backdrop panel, so that at least one of the opposite ends of the lower edge of the backdrop net may be raised to create a trough below the upper edge of the backdrop net in order to catch and collect balls that strike the backdrop net or the volleyball net section.

11. A method for creating a portable volleyball practice system for supporting a volleyball net mounted on a pair of posts, the method comprising:

providing a support frame, the support frame including a pair of elongated post supports, each of the elongated post supports being mounted on a base that is supported on wheels, each of the bases being connected to one another by a horizontal member of adjustable length, each of the post supports including:

an elongated recess adapted for accepting one of the posts in a generally parallel fashion relative to the post supports; and at least one adjustable retainer that has been adapted for fastening the posts against the recess; and providing a backdrop net, the backdrop net having an upper edge and a lower edge that is at a distance from the upper edge of the backdrop net, the lower edge of the backdrop net having a pair of opposite ends, each of the opposite ends being adapted for tethering each of the opposite ends to an anchoring point supported by the post supports; and releasably attaching the opposite ends of the lower edge of the backdrop net from the support posts, so that the opposite end of the lower edge may be raised or lowered relative to the upper edge of the backdrop net, so that the backdrop net may be used to retain or release balls by adjusting the height of the opposite ends of the backdrop net.

12. A method according to claim 11 wherein each of said post supports comprises an angled section, the angled section incorporating the recess adapted for accepting one of the posts in a generally parallel fashion relative to the post supports.

13. A method according to claim 11 wherein said at least one retainer comprises at least one strap that has been adapted for extending around the posts when the posts are mounted within the post supports, so that the posts are fastened against the post supports with the use straps.

14. A method according to claim 11 wherein each of said bases includes a support rack that are generally aligned with one another when said frame is in a collapsed position, so that the support racks on each base provide a support surface for posts.

15. A method according to claim 11 and further comprising releasably engaging a rope connected to one of the opposite ends of the lower edge of the backdrop panel to the support posts, so that at least one of the opposite ends of the lower edge of the backdrop net may be raised to create a trough below the upper edge of the backdrop net in order to catch and collect balls that strike the backdrop net or the volleyball net section.

* * * * *